US005195192A

United States Patent [19]

Garde

[11] Patent Number: 5,195,192

[45] Date of Patent: Mar. 23, 1993

[54] PORTABLE BATHING APPARATUS

[76] Inventor: Patria P. Garde, 1017 Rymill Rd., Cherry Hill, N.J. 08003

[21] Appl. No.: 731,193

[22] Filed: Jul. 15, 1991

[51] Int. Cl.[5] ..... A47K 3/06; A61H 33/00

[52] U.S. Cl. ..... 4/585; 4/547; 4/573.1; 4/588

[58] Field of Search ..... 4/585, 588, 584, 546, 4/547, 592, 593, 558, 573, 575, 578, 579, 559, 538; 220/9.1

[56] References Cited

U.S. PATENT DOCUMENTS

| | | | |
|---|---|---|---|
| 2,079,739 | 5/1937 | Houseweller | 4/584 |
| 2,329,326 | 9/1943 | Bloomberg | 4/538 X |
| 2,471,302 | 5/1949 | Boward | 4/588 |
| 2,541,029 | 2/1951 | Burton | 4/573.1 |
| 3,086,517 | 4/1963 | Dunkle | 4/559 X |
| 3,561,019 | 2/1971 | Roland | 4/593 |
| 3,808,610 | 5/1974 | Mortensen | 4/558 |
| 4,023,220 | 5/1977 | Younker | 4/585 X |
| 4,037,591 | 7/1977 | Sarno | 4/573.1 X |
| 4,068,326 | 1/1978 | Deschler | 4/588 X |
| 4,152,792 | 5/1979 | Glintz | 4/546 X |
| 4,535,490 | 8/1985 | Wright | 4/585 |
| 4,546,505 | 10/1985 | Wakenshaw | 4/585 X |
| 4,744,112 | 5/1988 | Kessling, Jr. | 4/585 |

FOREIGN PATENT DOCUMENTS

| | | | |
|---|---|---|---|
| 0461655 | 6/1928 | Fed. Rep. of Germany | 4/593 |

*Primary Examiner*—William A. Cuchlinski, Jr.
*Assistant Examiner*—John L. Beres
*Attorney, Agent, or Firm*—John Lezdey

[57] ABSTRACT

A portable bathing apparatus comprising a body length container having an inflatable wall which forms a shallow tub for holding water for bathing a person, the wall has a valve for inflating the wall from a source of air, the container is provided with a rigid bottom portion with a fluid egress means including a control valve for draining water from the container and removable apertured cushion means resting on its bottom portion.

6 Claims, 2 Drawing Sheets

PORTABLE BATHING APPARATUS

BACKGROUND OF THE INVENTION

1. Field of the Invention

This invention pertains to the field of personal health care equipment. More particularly, it pertains to a process of bathing an individual, who is confined to a bed, such as to enable one to receive body treatments such as bathing, massage and other administrations without contact between the provider of the services and the recipient thereof.

2. Description of the Prior Art

In providing health care, those in need are often gathered together to be treated by teams of specialists so that the efficiency of the treatment is intensified or that the total cost thereof is concentrated to be more efficacious. For instance, in hospitals, sanitariums and retirement centers, sick, infirm and aged persons in need of administrations such as physical therapy of the limbs and bathing are treated by teams of nurses, doctors and others who perform these services without traveling beyond the confines of the institution. In some situations, a single provider of services such as a physical therapist or a nurse may provide frequent bathing to number of individuals during any given period of time.

One can perceive, therefore, that a nurse giving baths to a number of patients would soon find his/her hands becoming sore from the loss of body oils through constant exposure to water and soap used in the bathing process. In other situations, individuals in need of specialized care are confined to their homes such as those who are aged and those who suffer from acquired immune deficiency syndrome (AIDS). The individual is virtually hopelessly confined in a bed and is to weak to leave the bed and travel to a shower stall and stand or sit to bathe. In these situations, there is a critical need to provide the services to the person in the bed and, further, to bar any direct contact between the patient's body and the provider's body.

The prior art has attempted to provide a barrier to such contact between those who are in need of such services and those who provide such services, with the use of rubber and plastic gloves on the hands of the provider. However, these have not become popular because of their aesthetics. The prior art shows certain apparatuses for bathing, such as are described in U.S. Pat. Nos. 3,749,064; 4,057,032; and 4,083,328. These devices, however, are generally restricted to placement over a tub or other container that already is provided with pressurized water and a water drain and are not useful for individuals lying in a bed separated from such a source of pressurized water or such a drain.

The prior art further shows certain body treatment apparatuses such as are described in U.S. Pat. Nos. 3,868,950; 4,034,424; 4,152,792; 4,353,349; and 4,485,502. However, all of these devices are restricted to having a person encased in some sort of apparatus resting in one position only so that they cannot turn or be turned over to expose other portions of their body for treatment. Other forms of prior art have provided apparatus, including pumps and other water-transfer devices, often powered by electrical motors, for transmitting water from one point to another. These devices pose a constant danger to both the provider and the recipient because of the use of the water or water containing compounds in the presence of electrical energy and the possibility of electrocution, and are otherwise very costly thus placing them beyond the reach of many patients with limited financial means.

U.S. Pat. No. 3,677,263, that utilizes an elongated sheath of water-tight material dimenioned to surround the body wherein means are provided for ingress and egress of fluids. The sheath is entered through an elongated opening having a sealable seam and the inside of the sheath is covered with a liner. This product has worked well over the years, however, it, too, has its own shortcomings and is useful only when coupled with expensive pumps and machinery to transfer water to and from the sheath.

There thus exists a continuing problem in the industry concerning home care or concentrated care, where the individual is confined to a bed and further, where the individual is suffering from a malady mandating a continuous, impervious barrier be established between the provider of services and the recipient. To date, there has been no such apparatus that is safe for use without the attendant problems of possible electric shock or that is totally portable and can be moved from a source of pressurized water to the bedside of the individual and that can be moved between individuals.

SUMMARY OF THE INVENTION

The object of the present invention can be achieved by providing a portable bathing apparatus comprising a body length container having an inflatable wall which forms a shallow tub for holding water for bathing a person. The inflatable wall has a valve for inflating the wall from a source of air. The container is also provided with a rigid bottom portion having a fluid egress means including a valve for draining water therefrom. Removable apertured cushion means is placed within the container to provide comfort for the bather.

Advantageously, a top sheath is provided which is placed on top of the container. The sheath has an opening so that the bather's head or upper body portion can protrude. The sheath has an opening or egress to permit warm air to enter and dry the bather. The sheath can be attached to the container.

For additional comfort or for bathing the hair of the bather an attachable pillow can be provided.

The objects and further advantages of the invention will be more apparent upon reading of the preferred embodiment in conjunction with the drawings.

DESCRIPTION OF THE PREFERRED EMBODIMENT

Figure 1:
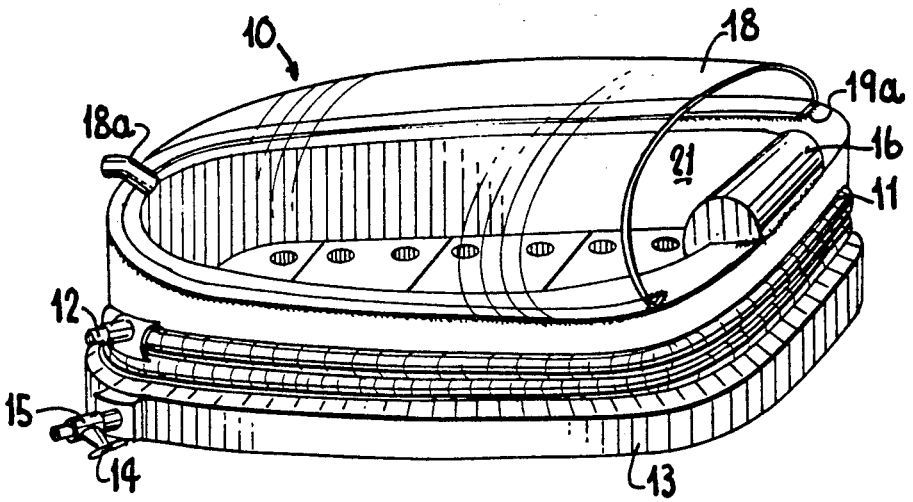
FIG. 1 is a perspective view of the bathing apparatus of the invention with the sheath and pillow.

FIG. 1 illustrates the bathing apparatus 10 of the present invention in its completely assembled condition, ready for use. It comprises a bottom portion 13 which is provided with a fluid egress 15 to drain bath water in the apparatus. The egress 15 is a manual control valve 14 which is closed when water is added and open to permit the water to drain by gravity. A flexible and inflatable portion 11 having an inflation valve 12 is removably attached to or can be integral with the bottom portion 13. The wall 21 of the inflatable portion 11 in its upright position with the bottom portion 13 forms a shallow tub which can be filled with water to permit bathing.

The flexible portion 11 can be easily attached to the bottom portion 13 during construction by known procedures when both the bottom portion 13 and the inflatable portion 11 are constructed from plastics, for example, polyethylene, polypropylene, and the like. The attachment can be with adhesives, sonic bonding, heat sealing and the like.

When the bottom portion 13 and the inflatable portion 1 are separable, the bottom portion 13 should be of rigid construction. Inflation of the flexible inflatable portion 11 creates a water tight seal with the bottom portion 13 similar to a tubeless tire.

Optionally, there may be included a top sheath 18 with means 18*a* for permitting warm air to be blown into the apparatus to dry the bather after the water is drained. Also, there can be provided a pillow 16 for the bather's comfort.

The apparatus is generally elongated so as to permit a bather to recline.

Figure 2:
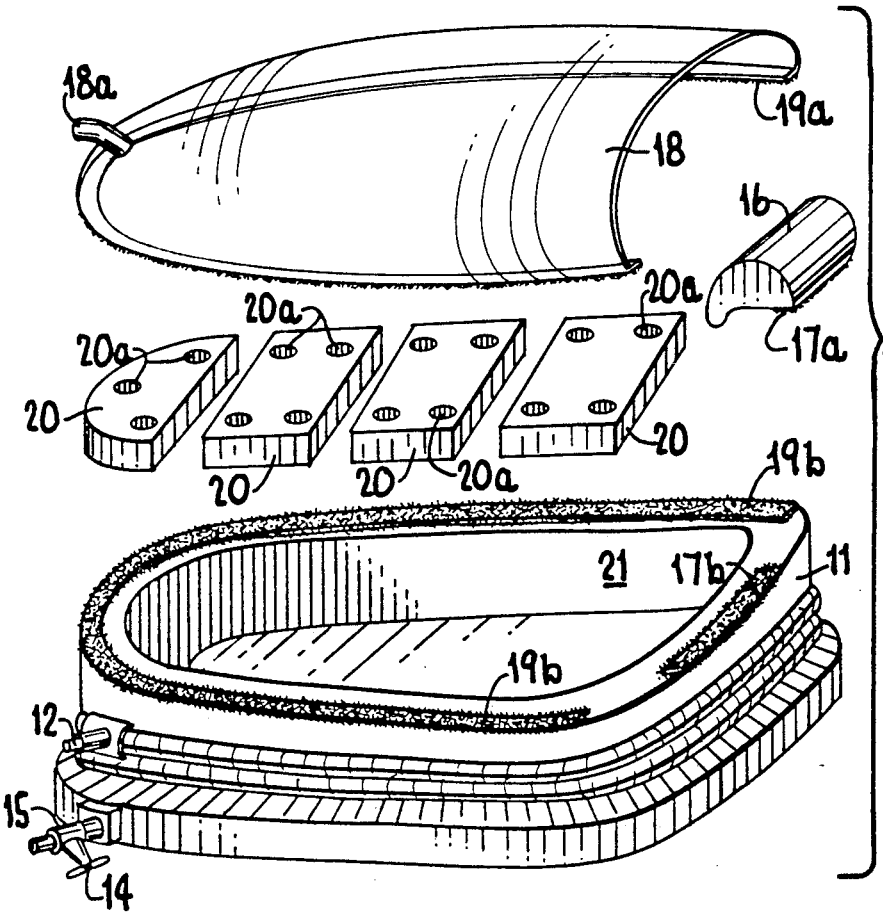
FIG. 2 is an elevational plan view of the apparatus of FIG. 1.

As seen in FIG. 2, a removable cushion 20 with drain holes 20*a* is provided in the apparatus 10 for the bather's comfort. The cushion 20 may be one piece or in sections for ease in handling.

The top sheath 18 can either be a rigid plastic or a flexible plastic sheet which can be rolled up and stowed away. It is preferred to have the sheath 18 transparent when dealing with invalids. However, the sheath can be opaque for the privacy of the bather. The top sheath can be held on the inflatable means by a suitable fastening means, for example, a hook 19*a* and loop 19*b* fastener (Velcro) as shown in the figure.

Similarly, the pillow 16 can be attached to the inflatable portion 11 with a hook 17*a* and loop 17*b* fastener (Velcro). The pillow 16 is preferably a water impervious foam material.

Figure 3:
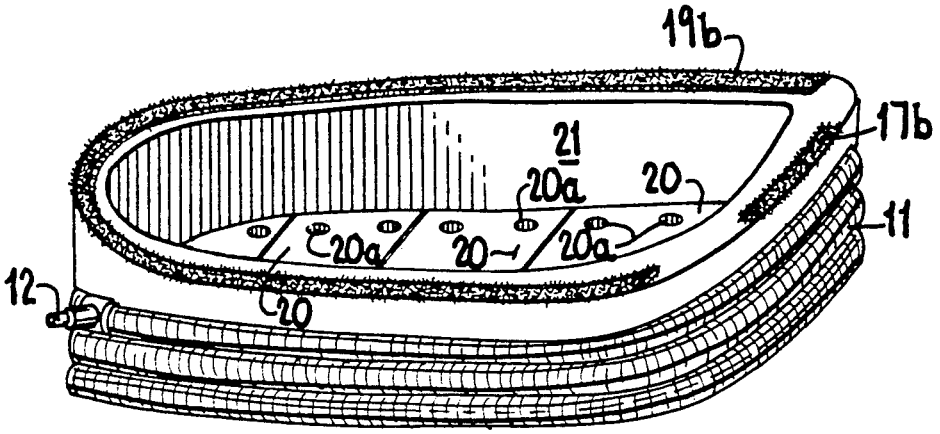
FIG. 3 is a perspective view of the inflatable wall of the apparatus of FIG. 1 with cushion means.

The inflatable portion 11 is shown in FIG. 3 with apertured sectional cushions 20 resting on an optional flexible plastic bottom layer 21*a* having apertures to permit drainage to the bottom portion 13. The flexible bottom layer 21*a* has been found to be helpful in maintaining the shape of the inflatable portion 11 so that it can be easily inserted in the bottom portion 13. The bottom layer 21*a* also aids in inflation by bulging the walls outwardly so as to form the tight seal.

Figure 4:
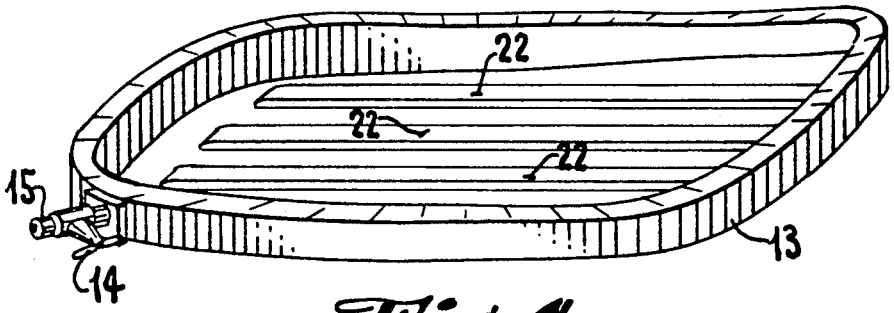
FIG. 4 is a perspective view of the bottom portion with the inflatable sidewall detached.

As shown in FIG. 4, the bottom portion 13 is sloped for gravity drain and is provided with ridges 22 to hold the cushions 20 from the bottom to permit drainage. Alternatively, in lieu of ridges, there may be drainage grooves.

It should be understood that the bathing apparatus can be utilized by connection with conventional hoses to water spigots and the drain means 15 can be similarly attached to a hose from a water drain or catch. The present apparatus is ideally suited for use with the combination air tank and drainage receptacle disclosed in U.S Pat. No. 4,935,971 which is herein incorporated by reference.

When the required amount of water has been put in the bathing apparatus, the invalid person bathes or is bathed by an attendant. When bathing is completed, the valve 14 is opened and the water is drained out. The cushions 20 are removed and any residual water can be removed using a sponge. The air from the portion 11 is removed so that the wall collapse. All of the parts being of light weight plastic material can be stowed away until further use. The apparatus 10 has the advantage that no tools are required for assembly and disassembly. The entire unit can be easily and inexpensively constructed from low cost plastic materials.

What is claimed is:

1. A portable bathing apparatus comprising a body length container having an inflatable wall which forms a shallow tub for holding water for bathing a person;

said wall having a valve for inflating said wall from a source of air and flexible means at its bottom for maintaining the shape of the bottom after deflation;

said container having a separable rigid bottom portion with an upwardly extending wall and a fluid egress means including a manual control valve for draining water from said container; and removable apertured means for cushioning said person resting on said bottom portion, wherein upon inflation of said inflatable wall a seal is formed with said wall of said rigid bottom portion.

2. The apparatus of claim 1 including a sheath on top of said container, said sheath having ingress means to permit the flow of air through the sheath and container.

3. The apparatus of claim 2 wherein said sheath is attached to said container with a loop and hook fastener.

4. The apparatus of claim 1 including a pillow attached to the top of said container.

5. The apparatus of claim 1 wherein said bottom portion contains means for permitting water to drain by gravity from said container when said cushion means is in said container.

6. A portable bathing apparatus comprising a body length container having an inflatable wall which forms a shallow tub for holding water for bathing a person;

said inflatable wall having a valve for inflating said wall from a source of air;

said container having a rigid bottom portion with an upwardly extending wall integral with said inflatable wall, said bottom portion having a fluid egress means including a manual control valve for draining water from said container, and removable apertured means for cushioning said person resting on said bottom portion, wherein upon inflation said inflatable wall forms a seal with the wall of said rigid bottom portion.

* * * * *